US009822613B2

(12) United States Patent
Crawford et al.

(10) Patent No.: US 9,822,613 B2
(45) Date of Patent: Nov. 21, 2017

(54) SYSTEM AND METHOD FOR RISERLESS SUBSEA WELL INTERVENTIONS

(71) Applicant: BLUE OCEAN TECHNOLOGIES LLC, Conroe, TX (US)

(72) Inventors: Neil Crawford, The Woodlands, TX (US); Ian R. Still, Bellaire, TX (US); Robert L. Ewen, Houston, TX (US); John R. Cook, Kingwood, TX (US); Kenneth R. Newman, New Waverly, TX (US); Travis Lee Bolt, Conroe, TX (US); Brandon Harman, Spring, TX (US)

(73) Assignee: OCEANEERING INTERNATIONAL, INC., Houston, TX (US)

( * ) Notice: Subject to any disclaimer, the term of this patent is extended or adjusted under 35 U.S.C. 154(b) by 0 days.

(21) Appl. No.: 15/065,508

(22) Filed: Mar. 9, 2016

(65) Prior Publication Data

US 2017/0260835 A1 Sep. 14, 2017

(51) Int. Cl.

| | |
|---|---|
| ***E21B 19/09*** | (2006.01) |
| ***E21B 19/22*** | (2006.01) |
| ***E21B 43/013*** | (2006.01) |
| ***E21B 33/038*** | (2006.01) |

(52) U.S. Cl.

CPC ..... *E21B 43/013* (2013.01); *E21B 19/09* (2013.01); *E21B 33/038* (2013.01)

(58) Field of Classification Search

CPC ..... E21B 19/09; E21B 19/22; E21B 33/038; E21B 33/076; E21B 43/013

See application file for complete search history.

(56) References Cited

U.S. PATENT DOCUMENTS

| | | | | |
|---|---|---|---|---|
| 4,825,953 A * | 5/1989 | Wong | E21B 29/04 | 166/338 |
| 4,899,823 A * | 2/1990 | Cobb | E21B 19/22 | 166/351 |
| 4,923,005 A * | 5/1990 | Laky | E21B 19/22 | 166/335 |
| 4,986,360 A * | 1/1991 | Laky | E21B 19/22 | 166/351 |
| 5,002,130 A * | 3/1991 | Laky | E21B 19/002 | 166/335 |
| 5,094,340 A | 3/1992 | Avakov | | |

(Continued)

*Primary Examiner* — Matthew R Buick
(74) *Attorney, Agent, or Firm* — Maze IP Law, PC

(57) ABSTRACT

The system for inserting a tubular member from a surface into a subsea well includes a riserless vessel, a surface injector being mounted on the vessel at the surface and delivering tubular member, such as coiled tubing, to the subsea well from the surface, a subsea snubbing jack releasably engaged to the tubular member, a subsea hydraulic power unit connected to the snubbing jack, and a device to maintain tension of the tubular member between the surface injector and the snubbing jack. The dynamic control of the subsea snubbing jack provides either active additional force for pipe light and pipe heavy conditions or passive support of the tubular member for equilibrium conditions without a riser. The method is responsive to transitions between well conditions. A riserless system without a subsea injector can more efficiently and reliably insert coiled tubing under various well conditions and during changes in the well conditions.

20 Claims, 2 Drawing Sheets

(56) References Cited

U.S. PATENT DOCUMENTS 5,309,990 A 5/1994 Lance
5,988,274 A 11/1999 Funk
5,992,516 A * 11/1999 Palynchuk ..... E21B 19/22 166/77.2
6,116,345 A * 9/2000 Fontana ..... B65H 75/22 166/343
6,158,516 A 12/2000 Smith et al.
6,843,321 B2 * 1/2005 Carlsen ..... E21B 19/002 166/355
6,854,520 B1 2/2005 Robicheaux
7,431,092 B2 * 10/2008 Haheim ..... E21B 19/22 166/343
7,438,505 B2 * 10/2008 Olsen ..... E02D 27/52 166/355
7,487,836 B2 * 2/2009 Boyce ..... E21B 19/002 166/338
7,891,429 B2 * 2/2011 Boyce ..... E21B 7/124 166/338
8,439,109 B2 * 5/2013 Sbordone ..... E21B 47/0001 166/250.01
8,485,262 B1 * 7/2013 Angers ..... E21B 33/043 166/339
8,720,582 B2 * 5/2014 Portman ..... E21B 19/22 166/344
8,863,846 B2 * 10/2014 Overstreet ..... E21B 19/086 166/338
9,022,124 B2 * 5/2015 Sorensen ..... E21B 19/22 166/351
9,151,123 B2 * 10/2015 Portman ..... E21B 19/002
9,347,294 B2 * 5/2016 Gramstad ..... E21B 19/22
2003/0178200 A1 9/2003 Fox et al.
2006/0078390 A1 4/2006 Olsen et al.
2007/0084606 A1 4/2007 Ponville
2008/0230228 A1 * 9/2008 Askeland ..... E21B 21/08 166/352
2011/0284234 A1 11/2011 Portman
2012/0006565 A1 1/2012 McKinnon et al.

* cited by examiner

SYSTEM AND METHOD FOR RISERLESS SUBSEA WELL INTERVENTIONS

CROSS-REFERENCE TO RELATED APPLICATIONS

See also Application Data Sheet

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a riserless well intervention system. In particular, the present invention relates to a subsea well intervention system having a surface injector and a snubbing jack at the subsea well without a riser. The present invention also relates to dynamic control of the subsea snubbing jack in a subsea well intervention system.

2. Description of Related Art Including Information Disclosed Under 37 CFR 1.97 and 37 CFR 1.98.

Well intervention is work performed on a well other than drilling. To manage the working life of a well, a well intervention can adjust production levels, modify the well, detect well conditions or perform other tasks in order to extend the working life of the well. Well intervention requires safely entering the well, which may be pressurized and actively producing. Drilling rigs have been used in conventional well intervention systems. A coiled tubing injector is mounted on a drilling rig to insert coiled tubing into the well.

Subsea wells present different problems because environmental conditions do not allow for ease and accessibility of the components of a conventional well intervention system. A surface injector on a rig or vessel on the ocean surface supplies and delivers the tubular member, such as coiled tubing. The ability to erect a rig or riser above a subsea well is limited and expensive. Dynamic positioning (DP) technology enables a vessel on the surface to reliably engage the subsea well for a riserless intervention system. When the subsea wellbore on the ocean floor is located thousands of feet away from the riserless system on a vessel at the surface, controls of the surface injector on the ocean surface must account for both surface conditions and subsea floor conditions at the same time. However, changes at the surface location do not correspond directly to conditions at the subsea location, and the translation of the effects of changes at the surface location can be distorted in the translation along the tubular member extending to the subsea location.

In the past, various well intervention systems have been developed. U.S. Pat. No. 6,854,520, issued to Robichaux on Feb. 15, 2005, describes an apparatus and method for handling a tubular in a conventional well. The disclosed components of a tubing injector and a snubbing jack for regular wells on land.

For subsea wells, U.S. Pat. No. 7,438,505, issued to Olsen on Oct. 21, 2008, teaches a prior subsea well intervention system mounted on a rig or riser. The riser has the pipe handling systems for injecting into the well, when the riser is directly aligned above the well. These conventional subsea well intervention systems require a heave compensation device to account for movement of the riser on the ocean surface.

Riserless systems have also been developed to remove the expense of a rig or riser as a large floating platform over the well. U.S. Pat. No. 8,720,582, issued to Portman on May 13, 2014, and U.S. Pat. No. 9,151,123, issued to Portman on Oct. 6, 2015, both disclose related systems and methods for providing tubing to a subsea well. The heave of the vessel and the devices to supply tubing and to inject tubing at the subsea well are disclosed. The systems use two injectors with heave compensation between the two injectors.

Injectors of these prior art system, including the riserless systems, have limitations. The injector controls the delivery and direction of tubing through the well and provides the thrust to snub into the well against pressure. A prior art injector is shown as FIG. 1 based on U.S. Pat. No. 5,309,990, issued to Lance on May 10, 1994. Two chain drives with gripper elements engage an entire length of the cylindrical tubing. There are multiple components and moving parts, which require a large amount of power. Components for the chain rotation motors, chain tensioning, chain gripping force and the necessary circuitry are necessary elements of an injector. In addition to the high amount of power requirement, there is a greater risk of failure due to the number of components and circuitry involved. There are several moving parts, and there is a lot of coordination necessary. Adding the subsea conditions, the problems are increased. The expense and equipment to deliver the necessary power, such as hydraulic power, to a subsea injector is increased. The ability to repair and maintain the chain drives in such a remote subsea location is difficult and expensive. Not all repairs can be performed by remote operated vehicles (ROVs) or in underwater conditions. An injector having an independent control or slave control still includes the lack of durability and extra weight of multiple components.

A snubbing jack or snubbing unit is another oilfield tool conventionally used to assist in the insertion of a tubular member into a wellbore. Tubular members can include conventional pipe, coiled tubing, and wireline. The wellbore is pressurized, so force can be required to push the tubular member. In "pipe light" conditions, the pressure of the wellbore is sufficient to resist the insertion of the tubular member. The snubbing jack provides the force to push the tubular member against the pressure of the wellbore. In "pipe heavy" conditions, the length of tubular member already in the wellbore has sufficient weight to accelerate the insertion of the tubular member. The snubbing jack provides the force to resist the pull on the tubular member by the length already within the wellbore.

In cooperation with an injector, the snubbing jack provides the additional thrust and energy for the insertion into and extraction from the well. For example, both cited prior art references, U.S. Pat. No. 6,854,520 and U.S. Pat. No. 7,438,505, disclose a tubing injector and a snubbing jack in cooperation with the tubing injector. For the prior art subsea well intervention, a riser is required, and the snubbing jack is located at the surface. U.S. Pat. No. 6,854,520 recognizes the need for the heavy components and multiple components on a floating platform aligned above the well in order to provide the necessary thrust to the well.

For a riserless subsea well intervention, injector weight and reliability remains a problem. Riserless systems, such as U.S. Pat. No. 8,720,582 and U.S. Pat. No. 9,151,123, manage the multiple components with master injector and slave injectors. Although the weight and power consumption of a slave injector can be less than the weight and power consumption of a master injector, the slave injector still remains an injector with the inherent problems of an injector, such as multiple components, weight, reliability, durability and accessibility when located at a subsea location.

It is an object of the present invention to provide a system for riserless subsea well interventions.

It is an object on the present invention to provide a system for riserless subsea well interventions without a subsea injector.

It is an object on the present invention to provide a system for riserless subsea well interventions having a surface injector and a subsea snubbing jack.

It is an object on the present invention to provide a method for dynamic control of the subsea snubbing jack for inserting a tubular member into a subsea well from a surface injector without a riser.

It is another object on the present invention to provide a dynamic riserless subsea well intervention system with a subsea snubbing jack and a subsea hydraulic power unit and surface controls through an electric umbilical.

It is another object on the present invention to provide a subsea snubbing jack with traveling slips and hydraulic actuation of the traveling slips in a dynamic system according to well conditions.

It is another object on the present invention to provide a subsea snubbing jack with a gripping force sufficient for inserting tubular members in "pipe light" conditions and "pipe heavy" conditions and conditions between "pipe light" and "pipe heavy" conditions.

It is another object on the present invention to provide a subsea snubbing jack with a subsea hydraulic power unit responsive to speed control of the surface injector.

It is still another object on the present invention to provide a subsea snubbing jack in a riserless well intervention resistant to cavitation.

It is still another object on the present invention to provide a subsea snubbing jack in a riserless well intervention and an ROV backup for the snubbing jack.

It is still another object on the present invention to provide a subsea snubbing jack in a riserless well intervention operated through a moon pool of a vessel.

These and other objects and advantages of the present invention will become apparent from a reading of the attached specification and appended claims.

BRIEF SUMMARY OF THE INVENTION

Embodiments of the present invention include a system for inserting a tubular member from an ocean surface into a well on an ocean floor without a riser. The system includes a vessel on the surface, which is not a rig or floating platform. There is no connection between the vessel and the ocean floor. There is a tubular member supply unit mounted on the vessel at the surface, and the tubular member is at least partially stored on the tubular member supply unit, such as a coiled tubing reel for coiled tubing. A surface injector is mounted on the vessel and connected to the tubular member supply unit by the tubular member. When a vessel has a moon pool, the surface injector can dispense the tubular member through the moon pool. The surface injector has at least one chain drive motor engaging the tubular member so as to control movement of the tubular member relative to the well from the surface. The system includes a snubbing jack located subsea on the well and releasable engaged to the tubular member. The snubbing jack can be comprised of a traveling slip bowl, a stationary slip bowl, and a hydraulic actuation means for movement of the traveling slip bowl relative to the stationary slip bowl. A subsea hydraulic power unit is in fluid connection to the snubbing jack and is also positioned subsea. The system further includes a heave compensation means for maintaining tension of the tubular member between the surface injector and the snubbing jack.

In some embodiments, there is an electric umbilical connecting a control unit at the surface to the subsea hydraulic power unit. Thus, the subsea snubbing jack is controlled by commands from the surface with less delay of transmission from the surface to the subsea location. The controls of the subsea snubbing jack can be separate from the controls of the surface injector. The subsea snubbing jack has a hydraulic actuation means that can be comprised of hydraulic cylinders or components for a rack and pinion engagement to the slips. The hydraulic actuation means can also be interlocking. The power required for the subsea snubbing jack is less than the power required for a subsea coiled tubing injector, whether the injector is a slave injector or master injector. The additional components and circuits require more power overall. The hydraulic actuation means is in a sealed fluid connection with the subsea hydraulic power unit so that releasable engagement of the tubular member by the traveling slips so that the subsea snubbing jack does not require compensation for cavitation, like an injector. Further embodiments of the present invention include a remote operative vehicle as a backup to the subsea hydraulic power unit. When repairs are needed, there is a cost effective and available backup, unlike prior art subsea injectors.

The present invention also includes embodiments of a method for inserting the tubular member from an ocean surface into a well on an ocean floor. The method includes mounting a tubular member supply unit and a surface injector on a vessel without a riser. The tubular member supply unit dispenses a tubular member to the surface injector. Then, the surface injector delivers the tubular member from the surface to the well at a subsea location and exerts a force for the tubular member to insert into the well at the subsea location. Next, a snubbing jack releasably engages the tubular member at the subsea location. The tubular member inserts into the well through the snubbing jack controlled by a subsea hydraulic power unit in fluid connection to the snubbing jack, while tension of the tubular member between the surface injector and the snubbing jack is maintained by a heave compensation device. The method includes dynamic control of the subsea snubbing jack to account for well conditions better than a subsea injector. The subsea snubbing jack can be active to provide additional force for both pipe light and pipe heavy conditions and for both insertions and extractions through the well. The subsea snubbing jack can also be passive as a support or guide only, when additional forces are not needed for insertion into the well at equilibrium between pipe light and pipe heavy conditions or for insertion into the well in pipe heavy conditions.

DETAILED DESCRIPTION OF THE INVENTION

Figure 1:
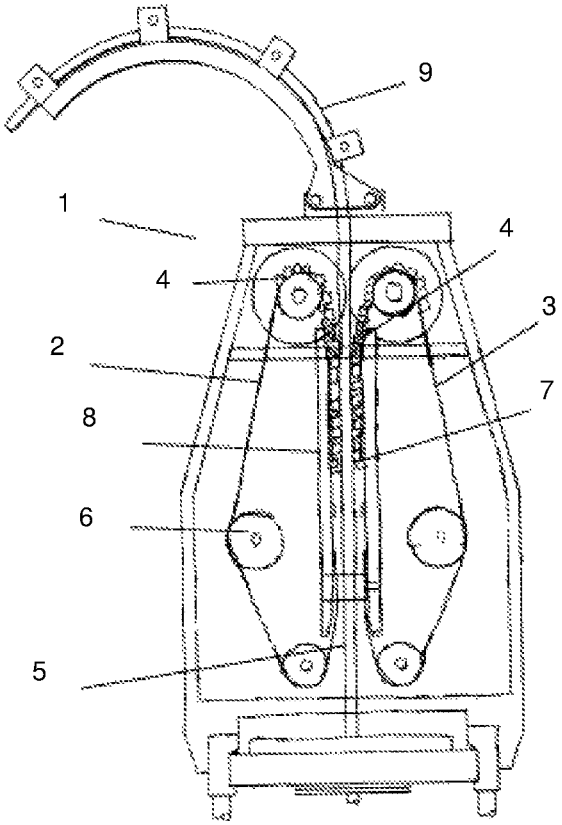
FIG. 1 PRIOR ART
FIG. 1 is a schematic view of a prior art injector for a subsea well intervention system, including riserless systems.

Subsea well intervention systems insert a tubular member, such as coiled tubing, from a location on the ocean surface into a subsea well on the ocean floor. Injectors control the delivery and direction of tubing through the well and provide the thrust to snub into the well against pressure. FIG. 1 shows a prior art injector 1 that can be mounted at the surface or at the floor. Each injector comprises multiple components, which require a large amount of power. For example, two chain drives 2, 3 with respective gripper elements 4 are used to engage an entire length 5 of the cylindrical tubing. Various other components facilitate and support these basic components, including but not limited to circuits, rotation motors 6, tensioning devices 7, and gripping adjustors 8. Prior art technology has developed to make injectors more powerful and efficient for the amount of force generated on the tubular member 9. The speed of injection and gripping area on the tubular member are advantages of an injector.

The distance from surface to subsea floor is an obstacle for effective well interventions. Both systems with risers and without risers have an injector at the surface, either on a vessel or on a rig. The amount of power needed to transfer force generated at the surface to the subsea well is already significant, and the distance from surface to floor further increases the weight of components and power consumption of the injector. Prior art systems position injectors on the subsea floor as subsea injectors in order to reduce the distance traveled by the force from the injector to the well. However, positioning an injector subsea creates a different set of complications. Instead of simply sending the desired speed of injection and superior gripping area to a subsea location, the subsea injector also brings a different lack of responsiveness between the surface and the subsea injector, greater risk of failure due to the number of components and circuitry involved and an expensive lack of accessibility for maintenance and repair.

Figure 2:
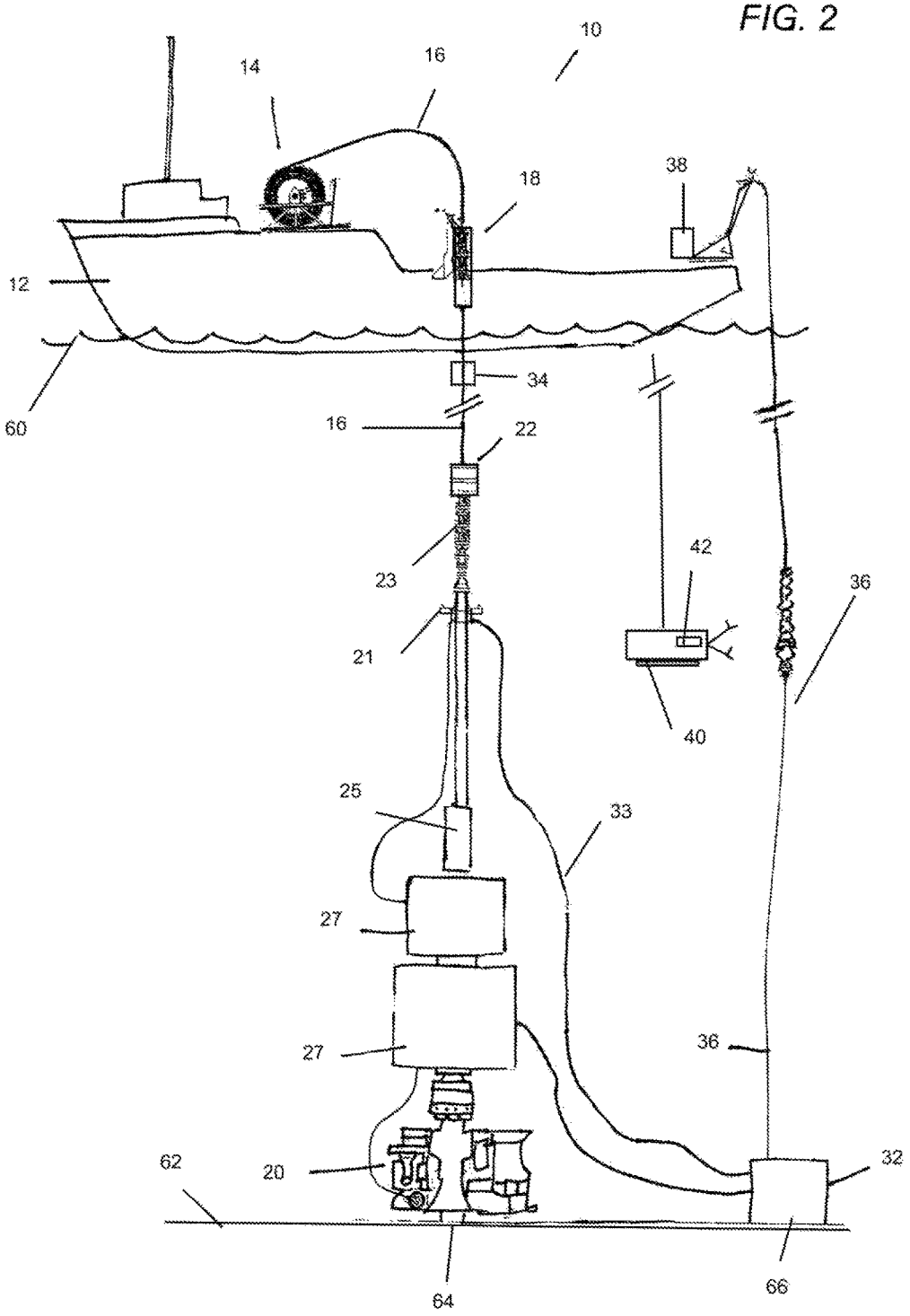
FIG. 2 is a schematic view of the system and method for subsea well intervention according to the present invention.

FIG. 2 shows the system 10 of the present invention without a riser and without a subsea injector. The dynamic control of the subsea snubbing jack enables the present invention to insert tubular members into the subsea well with fewer components, less power, and more accessibility for maintenance and repairs. The system 10 includes a vessel 12 without a riser. The vessel 12 is not a rig or floating platform with a connection to the ocean floor. The expense and availability of a drilling rig is not required for the system 10 of the present invention. In some embodiments, a vessel 12 can be a large ship, including a ship with a moon pool. The vessel 12 is located at the surface. The system 10 also includes a tubular member supply unit 14 mounted on the vessel 12 and a tubular member 16 at least partially stored on the tubular member supply unit 14. Embodiments include a coiled tubing unit with a reel with coiled tubing as a continuous tubular member to be inserted into and withdrawn from the subsea well.

Embodiments of the system 10 still include an injector, and FIG. 2 shows a surface injector 18 mounted on the vessel 12 and connected to the tubular member supply unit 14 by the tubular member 16. The surface injector 18 can be installed along a center line of a large ship or through a moon pool, when the vessel 12 has a moon pool. The surface injector 18 dispenses the tubular member 16, such as coiled tubing from the surface 60. The surface injector 18 has at least one chain drive motor, such as the chain drive 2 in FIG. 1, engaging the tubular member 16 for conventional control and thrust of the tubular member 16. The speed of injection and gripping area are consistent with conventional injectors.

Figure 3:
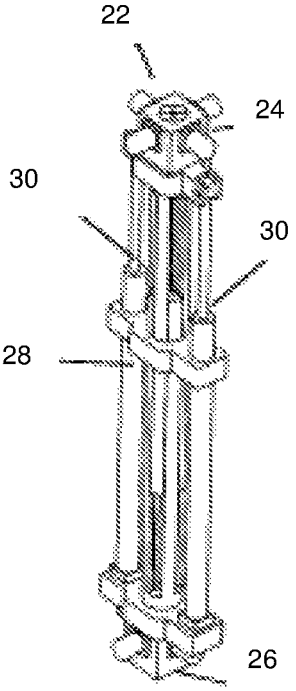
FIG. 3 is a perspective view of an embodiment of a snubbing jack of the system for subsea well intervention according to the present invention.

FIGS. 2 and 3 show embodiments of the snubbing jack 22 of the system 10 of the present invention. The snubbing jack 22 can connect to the surface injector 18 by the tubular member 16. The snubbing jack 22 is located at a first subsea location 64 on the subsea floor 62, close to the well 20 and away from the surface 60. The snubbing jack 22 can be placed on top of the well 20 and other components, such as lubricators 21, tubing strippers 23, well control package connectors 25, and well control modules 27. The snubbing jack 22 is releasably engaged to the tubular member 16. The snubbing jack 22 can grip and release portions of the tubular member 16 for the insertion or extraction, as the tubular member 16 passes through the snubbing jack 22. In the present invention, FIG. 3 shows the snubbing jack 22 comprised of a traveling slip bowl 24, a stationary slip bowl, 26, and a hydraulic actuation means 28 for movement of the traveling slip bowl 24 relative to the stationary slip bowl 26. The stationary slip bowl 26 releasably engages the tubular member 16, such that the tubular member 16 passes through the stationary slip bowl 26 as the traveling slip bowl 24 moves toward the stationary slip bowl 26. The traveling slip bowl 24 releasably engages the tubular member 16 in a different manner. The traveling slip bowl 24 grips a portion of the tubular member 16 so that the traveling slip bowl 24 and that portion of the tubular member 16 moves toward the stationary slip bowl 26. When the traveling slip bowl 24 reaches close enough to the stationary slip bowl 26, the traveling slip bowl releases that portion of the tubular member 16. The slip bowls 24, 26 can also be interlocked so that one slip does not open until the other slip is closed. Thus, a length of tubular member 16 has been inserted into the well, and that length matches the distance traveled by the traveling slip bowl 24 towards the stationary slip bowl 26.

FIG. 3 shows the hydraulic actuation means 28 as comprised of hydraulic cylinders 30. In this embodiment, the movement of the hydraulic cylinders 30 corresponds to movement of the traveling slip bowl 24 relative to the stationary slip bowl 26. In an alternate embodiment, the hydraulic actuation means 28 can be comprised of hydraulic motor, a circular gear driven by the hydraulic motor, and a linear gear in rack and pinion engagement to the circular gear (not shown). In this embodiment, the movement of the linear gear corresponds to movement of the traveling slip bowl 24 relative to the stationary slip bowl 26. The snubbing jack 22 is hydraulic, requiring hydraulic fluid and hydraulic components for moving the traveling slip bowl 24. The snubbing jack 22 can also include more than one set of each slip bowls 24, 26, and more than the two hydraulic cylinders 30 of FIG. 3 can be required to power the snubbing jack 22 in those other embodiments. The amount of hydraulic power and the number of hydraulic cylinders will also be less than the hydraulic power required for an injector. The number of components, circuits, and moving parts of the snubbing jack remain significantly less than an injector.

Referring to FIG. 2, the system 10 further includes a subsea hydraulic power unit 32 in fluid connection 33 to the snubbing jack 22. The hydraulic power unit 32 is shown at a second subsea location 66, separate from the snubbing jack 22 on the well 20, but still at the subsea floor 62. The hydraulic power unit 32 provides the power and hydraulic fluid and controls for the hydraulic actuation means 28 of the snubbing jack 22. In embodiments of the present invention, the hydraulic actuation means 28 is in a sealed fluid connection with the subsea hydraulic power unit 32. The responsiveness of the snubbing jack 22 is greatly increased, especially when the hydraulic actuation means 28 is comprised of hydraulic cylinders 30 of FIG. 3. The hydraulic bladders of the hydraulic power unit 32 at the subsea floor 66 are pressurized subsea similar to the hydraulic actuation means 28 of the snubbing jack 22. The control and power does not travel from the surface 60 at ambient pressure, as in the prior art. Subsea injectors still connect to the surface for hydraulic power, which can still be delayed and distorted as the hydraulic power or pulse travels through water. Additionally, there is less need to account for cavitation in an injector because the hydraulic power unit 32 is already subsea with the snubbing jack 22. For example, the snubbing jack 22 can be more responsive to the transition to "pipe heavy" conditions when inserting the tubular member 16, unlike the cavitation caused by that same transition in a subsea injector. The snubbing jack 22 at the first subsea location can be quickly and responsively controlled by the subsea hydraulic power unit 32 as the second subsea location 66.

The system 10 further includes a heave compensation means 34 between the surface injector 18 and the snubbing jack 22. The heave compensation means 34 can maintain tension of the tubular member 16 between the surface injector 18 and the snubbing jack 22 so that the system 10 accounts for the distance between the surface 60 and the floor 62. Embodiments can include the heave compensation means 34 as active or passive. As such, the heave compensation means 34 can be selected from a spring device for passive compensation, or winches and cylinders for active compensation.

FIG. 2 also shows an embodiment of the system 10 with an electric umbilical 36 connecting a control unit 38 at the surface to the subsea hydraulic power unit 32. The control unit 38 can even be mounted on the vessel 12 with a different connection from the surface 60 to the second subsea location 66. The snubbing jack 22 is controlled by commands through the subsea hydraulic power unit 32 from the electric umbilical 36 and control unit 38 at the surface. There is little or no delay in the communication from the surface to the snubbing jack 22 at the first subsea location. The tubular member 16 or coiled tubing from the surface is no longer the means of communication between the surface injector 18 and the snubbing jack 22. Unlike the prior art systems with a subsea slave injector, the system 10 is actively managed at the surface and subsea, instead of being managed at the surface with projections to account for the delay transmission of hydraulic power in whatever condition the tubular member 16 is at the well 20 or at a subsea slave injector. The control of the snubbing jack 22 can be separate from the surface injector 18.

A further embodiment of the present invention includes a system 10 with a remote operative vehicle (ROV) 40 as a back up to the subsea hydraulic power unit 32. The ROV 40 can be comprised of an additional hydraulic power unit 42, such that deployment of the ROV 40 positions the additional hydraulic power unit 42 at a subsea location. The additional hydraulic power unit 42 engages the snubbing jack 22 for a fluid connection with the snubbing jack 22, so that hydraulic fluid of the additional hydraulic power unit 42 powers the snubbing jack 22 instead of the subsea hydraulic power unit 32. The ROV 40 can be a backup system so easier repair and maintenance of the system 10 without disassembly at the well. When repairs are needed, the system 10 includes a cost effective and available alternative.

Embodiments of the present invention include a method for a subsea well intervention from an ocean surface to a well on an ocean floor. The system 10 can be used in these steps. First, the tubular member supply unit 14 and a surface injector 18 are installed on a vessel 12 on the surface 60 without a riser. The tubular member supply unit 12 dispenses a tubular member 16 to the surface injector 18 so that at least one chain drive motor engages the tubular member 16 for control and thrust of the tubular member 16 through the well. The tubular member 16 is delivered from the surface injector 18 at the surface 60 to a snubbing jack 22 at a subsea location 64 under tension maintained by a heave compensation means 34 or heave compensation device between the surface injector 18 and the snubbing jack 22. The surface injector 18 exerts a force for the tubular member 16 to move into or out of the well.

The method further comprises releasably engaging the tubular member 16 at the subsea location with the snubbing jack 22, according to the well conditions. With the snubbing jack 22 being comprised of a traveling slip bowl 24, a stationary slip bowl, 26, and a hydraulic actuation means 28 for movement of the traveling slip bowl 24 relative to the stationary slip bowl 26, each slip bowl 24, 26 releasably engages the tubular member 16, according to the dynamic control of the present invention. The stationary slip bowl 26 is stabilized on the well 20. The traveling slip bowl 24 grips a portion of the tubular member 16 so that the traveling slip bowl 24 and the portion of the tubular member 16 moves toward the stationary slip bowl 26. When the traveling slip bowl 24 reaches close enough to the stationary slip bowl 26, the traveling slip bowl releases the portion of the tubular member 16. The slip bowls 24, 26 can also be interlocked so that one slip does not open until the other slip is closed. The stationary slip bowl 26 can grip a second portion of the tubular member 16 as the traveling slip bowl 24 returns to the original position of the traveling slip bowl 24. The stationary slip bowl 26 can hold the tubular member 16 so that the tubular member 16 does not fall through the well 20 or shoot from the well 20, during the return stroke of the snubbing jack 22. Thus, the tubular member 16 is inserted into the well 20 by the surface injector 18 and through the snubbing jack 22 or is withdrawn from the well 20 by the surface injector 18 and through the snubbing jack 22.

When the well is in a pipe light condition, the pressure in the well 20 resists the insertion of the tubular member 16. Thus, the traveling slip bowl 24 engages the tubular member 16 so that the snubbing jack 22 exerts a first additional force on the tubular member 16 into the well 20 against well pressure. Whatever thrust from the surface injector 18 is available at the well is used in conjunction with the first additional force of the snubbing jack 22.

When the well is in a pipe heavy condition, weight of tubular member 16 already in the well 20 pulls the tubular member 16 into the well 20. Thus, the traveling slip bowl 24 engages the tubular member 16 so that the snubbing jack 22 exerts a second additional force on the tubular member 16 against weight of the tubular member 16 already in the well. The insertion into the well remains controlled for the proper depth and location down the wellbore.

It should be noted that the first additional force and the second additional force can be reversed, when the tubular member 16 is withdrawn from the well. The snubbing jack 22 can be easily managed to engage the tubular member 16, when exiting through the well in pipe light conditions. The traveling slip bowl 24 resists the tubular member 16 shooting too quickly from the well, when the pressure in the well provides additional well force for expelling the tubular member 16. Consequently, the traveling slip bowl 24 exerts additional force for the expulsion of the tubular member 16, despite the extra weight of the tubular member 16 still within the well.

When the well is in an equilibrium condition between the pipe light condition and the pipe heavy condition, no additional force in either direction is needed for the insertion into or exit from the well. The snubbing jack 22 of the system 10 is no longer needed for exerting any force beyond what is already being delivered by the surface injector 18. In some other embodiments, the traveling slip bowl 24 can release the tubular member 16 so as to disengage the snubbing jack 22. The snubbing jack 22 only acts as a guide to the tubular member 16 inserting or exiting through the well, and the surface injector 18 moves the tubular member 16 through the snubbing jack 22 and the well 20. In other embodiments, the traveling slip bowl 24 engages the tubular member 16 without exerting force so as to allow the snubbing jack 22 to support the tubular member 16 to continue inserting or exiting through the well. For example, when the equilibrium condition is about to end and transition to either pipe light or pipe heavy conditions, the traveling slip bowl 24 can engage without exert force, so that the snubbing jack 22 can quickly respond to the transition.

Embodiments of the present invention include the step of releasably engaging the tubular member 16 by dynamic control of the snubbing jack 22, according to conditions of the well. There is no prior art system with a subsea snubbing jack. The subsea systems with a riser have the snubbing jack at the surface. The subsea systems without a riser have a subsea injector. The method of the present invention can toggle between active and passive performance of the snubbing jack 22 better than a subsea injector. In the prior art with riserless subsea systems, a slave injector is placed subsea. In the present invention, there is no longer a need for a slave component for additional force subsea. The snubbing jack of the present invention is controlled to be active for providing additional force for pipe light conditions and passive for the "sweet spot" of an equilibrium condition between the pipe light condition and the pipe heavy conditions.

The method of the present invention can also include connecting an electric umbilical between a control unit at the surface and the subsea hydraulic power unit. Commands from the surface are relayed through the electric umbilical to the subsea hydraulic power unit and then the subsea snubbing jack. The commands are virtually instantaneous from surface to floor. The subsea hydraulic power unit can provide the power to the subsea snubbing jack with less delay and distortion. Prior art signals or hydraulic power through coiled tubing from the surface require additional time to travel from surface to subsea, and the signals are sent to a subsea injector, not a subsea snubbing jack. The pressure differentials at the surface further distort when received at subsea pressures. Embodiments of the method allow for active control of the snubbing jack to exerting each additional force according to the commands. The snubbing jack can be managed to exert one force under pipe light conditions for inserting into the well and to exert a different force under pipe light conditions for withdrawing from the well. Furthermore, the responsiveness to account for the transitions between well conditions is vastly improved. Alternative embodiments of the method include releasing the tubular member by the snubbing jack, so that the surface injector controls the insertion or withdrawal during equilibrium conditions. The snubbing jack experiences less wear, and there are fewer components to be experiencing wear, compared to any subsea injector. The snubbing jack has increased durability and liability in the system and method of the present invention.

Another alternative step in embodiments of the method is the backup process. In the present invention, the ROV can have an additional hydraulic power unit compatible as a substitute for the subsea hydraulic power unit. The ROV can easily deliver this substitute to the subsea location of the well for temporary repairs. Removal and lifting of an injector from the floor to the surface is no longer required for riserless systems. When the hydraulic power unit is offline, the ROV can bring an additional power unit, while maintenance is performed. The prior art subsea injector would require more hydraulic power than available on a subsea power unit delivered by an ROV. Currently, an ROV would be unable to provide enough tanks or large enough tanks for hydraulics of an injector, even smaller injectors. The fewer components and simplicity of the snubbing jack relative to an injector, even a smaller slave injector, enable the ROV as a subsea repair possibility for the system and method.

The present invention provides a system for riserless subsea well interventions. In the prior art, the subsea injector still relies on hydraulics from the surface. The delay and degradation of the hydraulic power to affect the subsea injector reduces effectiveness and responsiveness to subsea conditions. The present invention locates a subsea hydraulic power unit on the ocean floor for more responsiveness to a subsea snubbing jack. The system does not even require a subsea injector because a simpler subsea snubbing jack is enabled to replace the subsea injector. Snubbing jacks have not been installed subsea. The system enables a surface injector and a snubbing jack to insert or withdraw the tubular member from the well without a riser. The components and controlled relationship of the components of the system allow for a vessel to support the surface injector for the subsea snubbing jack and subsea hydraulic power unit, including supporting the surface injector through a moon pool in the middle of a large ship. Additionally, the dynamic riserless subsea well intervention system of the present invention controls the subsea snubbing jack and a subsea hydraulic power unit through an electric umbilical. Again the responsiveness of electrical connections and subsea hydraulic power enables the simpler and efficient snubbing jack to outperform prior art snubbing jacks and subsea injectors.

The subsea snubbing jack with traveling slips and hydraulic actuation of the traveling slips perform as a dynamic system, according to well conditions and being more responsive to transitions between well conditions. The subsea snubbing jack has a gripping force sufficient for inserting tubular members in "pipe light" conditions and "pipe heavy" conditions. The subsea snubbing jack can release the gripping force in equilibrium conditions between "pipe light"

and "pipe heavy" conditions by releasing the traveling slips or by not exerting force with the traveling slips engaged. When close to a transition from equilibrium to either pipe light or pipe heavy conditions, the snubbing jack can more quickly react and begin to exert force, when the traveling slip is already engaged to the tubular member. The responsive avoids cavitation and the need to compensate for cavitation in the prior art injectors.

In the prior art, conventional well intervention systems and subsea well intervention systems with risers only disclose surface based snubbing jack and injectors. Even as a slave injector is sent subsea, the control and power remains on the surface. Even reducing weight and power consumption for the subsea injector is being used to minimize the delay and distortion for the control and power through coiled tubing from the surface to the subsea location. These prior art systems still locate an entire injector at a subsea level, requiring a large amount of energy to deliver the weight of the injector to the subsea location, greatly reducing the ability maintain and repair the many components, and decreasing the durability of the subsea injector. Even being made lighter, the subsea injector remains an injector with these same problems.

The present invention has a system with dynamic control of the snubbing jack to provide the additional force for pipe light and pipe heavy conditions. Although the gripping area and gripping force are different and possibly less than an injector, the gripping area and gripping force of a snubbing jack can be still be sufficient for the additional force needed for inserting and withdrawing tubular members from the well. The snubbing jack has fewer components, simpler components, less weight and more accessibility for maintenance and repair. The present invention has the benefit of modifying the snubbing jack to have sufficient power previously supplied by an entire injector. The prior art riserless systems "over-engineered" with modifications to the subsea injector, which inherently has more functionality than a snubbing jack. The advancements for lighter injectors and more power efficient injectors emphasized the need to get an injector subsea. Relying on an injector to solve the issues of riserless systems, the prior art never looked beyond to other components.

Furthermore, the well conditions are not always "pipe light" or "pipe heavy". In fact, there is an equilibrium or "sweet spot" of the well conditions between pipe light and pipe heavy in which additional forces by a snubbing jack are not needed in either direction through the well. The speed of tubing by the surface injector is manageable without alterations at the well. Such insertions and withdrawal are the most efficient, and prolonging the equilibrium is desirable for most well interventions. In the present invention, the snubbing jack can toggle between an active mode providing the additional forces and a passive mode allowing the surface injector to work in the equilibrium well conditions. That passive mode can be characterized by the snubbing jack releasing the tubular member as the tubular member passes through to the well or continuing to engage the tubular member as a support, guide or safety without exerting additional forces. For example, when projections show that the equilibrium condition is about to transition, the snubbing jack can engage the tubular without exerting additional force, until the transition. The system is more responsive to the changing conditions.

The dynamic control of the snubbing jack can be separate, yet more responsive to speed of the surface injector. Subsea injectors, including slave injectors, cannot have the same dynamic control. There are too many moving parts, circuits, and components with the gears, chains, chain tensioners, and grip tensioners, etc. Additionally, in the transitions between well conditions, an injector cannot avoid cavitation, such that most injectors have additional components to compensate for this risk. The delay in recognition and delivery of power from the surface to the well allows transitions from an equilibrium condition to either pipe light or pipe heavy to cause damage and wear, in addition to additional power consumption to compensate for the transtition. The present invention avoids the risks and damages with the relationship of the subsea hydraulic power unit, the subsea snubbing jack, and the electrical umbilical. The system is more efficient and responsive during transitions, which avoids the problems of prior art injectors. The closer subsea relationship, sealed fluid connection and simpler components of the present invention overcome significant problems in the prior art. Even if an injector could be completely disengaged so that the chain drive released the tubular member, the injector would be an expensive waste of technology in order to perform no work subsea. Even if an injector could be run passively as a support, guide, or safety, all of the moving parts would continue to wear without performing any actual work. The present invention continues to present solutions for riserless subsea well interventions beyond the prior art, and other advantages may be more apparent in the future.

The foregoing disclosure and description of the invention is illustrative and explanatory thereof. Various changes in the details of the described method can be made without departing from the true spirit of the invention.

We claim:

1. A system for inserting a tubular member from a surface into a well on a subsea floor, said system comprising:

a vessel being without a riser connected to the well and being on the surface;

a tubular member supply unit mounted on the vessel at the surface;

a tubular member at least partially stored on said tubular member supply unit;

a surface injector mounted on the vessel at the surface and connected to said tubular member supply unit by said tubular member, said surface injector having at least one chain drive motor configured to engage said tubular member so as to control movement and thrust of said tubular member relative to the well from the surface;

a snubbing jack located at a first subsea location and engaged to the well on the subsea floor, the snubbing jack comprising:

a traveling slip bowl releasably engagable to said tubular member;

a stationary slip bowl releasably engagable to said tubular member; and a hydraulic actuator cooperatively connected to said traveling slip bowl and configured to allow movement of said traveling slip bowl relative to said stationary slip bowl;

a subsea hydraulic power unit in fluid connection to said snubbing jack and being located at a second subsea location; and a heave compensator disposed between said surface injector and said snubbing jack so as to maintain tension of said tubular member between said surface injector and said snubbing jack.

2. The system for inserting the tubular member, according to claim 1, further comprising:

an electric umbilical connecting a control unit at the surface to said subsea hydraulic power unit, wherein said snubbing jack is controlled by commands through said subsea hydraulic power unit from said electric umbilical at the surface.

3. The system for inserting the tubular member, according to claim 1, wherein said hydraulic actuator further comprises hydraulic cylinders.

4. The system for inserting the tubular member, according to claim 3, wherein movement of said hydraulic cylinders corresponds to movement of said traveling slip bowl relative to said stationary slip bowl.

5. The system for inserting the tubular member, according to claim 1, wherein said hydraulic actuator further comprises a hydraulic motor, a circular gear driven by said hydraulic motor, and a linear gear in rack and pinion engagement to said circular gear.

6. The system for inserting the tubular member, according to claim 5, wherein movement of said linear gear corresponds to movement of said traveling slip bowl relative to said stationary slip bowl.

7. The system for inserting the tubular member, according to claim 1, wherein said hydraulic actuator is in a sealed fluid connection with said subsea hydraulic power unit.

8. The system for inserting the tubular member, according to claim 1, further comprising a remotely operated vehicle comprising an additional hydraulic power unit, the remotely operated vehicle being positioned at a subsea location so as to engage said snubbing jack, wherein said additional hydraulic unit is in fluid connection with said snubbing jack as a backup subsea hydraulic power unit.

9. The system for inserting the tubular member, according to claim 1, wherein said heave compensator comprises an active heave compensator.

10. The system for inserting the tubular member, according to claim 1, wherein 1, wherein said heave compensator comprises a passive heave compensator.

11. The system for inserting the tubular member, according to claim 1, wherein said vessel further comprises a moon pool and said surface injector extends from the vessel through said moon pool.

12. A method for a subsea well intervention from an ocean surface to a well on a subsea floor, said method comprising:

installing a tubular member supply unit and a surface injector on a vessel without a riser connected to the well and being on the surface, wherein said tubular member supply unit dispenses a tubular member to said surface injector, said surface injector comprising at least one chain drive motor engaging said tubular member for control and thrust of said tubular member through the well;

delivering said tubular member from said surface injector at the surface to a snubbing jack at a subsea location under tension maintained by a heave compensator disposed between said surface injector and said snubbing jack;

exerting a force by said surface injector for said tubular member through the well;

releasably engaging said tubular member at the subsea location with said snubbing jack, said snubbing jack comprising a traveling slip bowl, a stationary slip bowl, and a hydraulic actuator for movement of said traveling slip bowl relative to said stationary slip bowl, each slip bowl being releasably engaged to said tubular member, wherein said snubbing jack is in fluid connection with a subsea hydraulic power unit; and inserting said tubular member into the well by said surface injector and through said snubbing jack.

13. The method for inserting the tubular member, according to claim 12, wherein said traveling slip bowl engages said tubular member, said snubbing jack exerting a first additional force so as to insert said tubular member into the well against well pressure, when the well is in a pipe light condition.

14. The method for inserting the tubular member, according to claim 13, wherein said traveling slip bowl engages said tubular member, said snubbing jack exerting a second additional force so as to support said tubular member against weight of said tubular member already in the well, when the well is in a pipe heavy condition.

15. The method for inserting the tubular member, according to claim 14, wherein said traveling slip bowl engages said tubular member, said snubbing jack guiding said tubular member inserting through the well, when the well is in an equilibrium condition between said pipe light condition and said pipe heavy condition.

16. The method for inserting the tubular member, according to claim 14, wherein said traveling slip bowl releases said tubular member, said tubular member inserting through said snubbing jack and the well, when the well is in an equilibrium condition between said pipe light condition and said pipe heavy condition.

17. The method for inserting the tubular member, according to claim 12, wherein the step of releasably engaging said tubular member further comprises:

connecting an electric umbilical between a control unit at the surface and said subsea hydraulic power unit, wherein said snubbing jack is controlled by commands through said subsea hydraulic power unit from said electric umbilical at the surface.

18. The method for inserting the tubular member, according to claim 15, wherein the step of releasably engaging said tubular member further comprises:

connecting an electric umbilical between a control unit at the surface and said subsea hydraulic power unit, wherein said snubbing jack is controlled by commands through said subsea hydraulic power unit from said electric umbilical at the surface; and exerting each force according to said commands, said commands being coordinated with the step of delivering said tubular member from said surface injector and the step of exerting said force by said surface injector.

19. The method for inserting the tubular member, according to claim 16, wherein the step of releasably engaging said tubular member further comprises:

connecting an electric umbilical between a control unit at the surface and said subsea hydraulic power unit, wherein said snubbing jack is controlled by commands through said subsea hydraulic power unit from said electric umbilical at the surface;

exerting each force according to said commands, said commands being coordinated with the step of delivering said tubular member from said surface injector and the step of exerting said force by said surface injector; and releasing said tubular member according to said commands, said commands being coordinated with the step of delivering said tubular member from said surface injector and the step of exerting said force by said surface injector.

20. The method for inserting the tubular member, according to claim 12, wherein the step of inserting said tubular member into the well through said snubbing jack further comprises:

substituting an additional hydraulic power unit of a remote operative vehicle for said hydraulic power unit, when said hydraulic power unit is offline, the vehicle being positioned at a subsea location.

* * * * *